United States Patent [19]

Bickoff et al.

[11] 3,960,256

[45] June 1, 1976

[54] ADJUSTABLE CARRIAGE APPARATUS

[75] Inventors: Charles Bickoff, Acton; St. John Merrill Hall, Jr., Sharon, both of Mass.

[73] Assignee: Digital Equipment Corporation, Maynard, Mass.

[22] Filed: Oct. 21, 1974

[21] Appl. No.: 516,513

[52] U.S. Cl. ..... 197/1 R; 197/55

[51] Int. Cl.[2] ..... B41J 3/04

[58] Field of Search ..... 197/1 R, 16, 18, 55, 197/60

[56] References Cited

UNITED STATES PATENTS

| | | | |
|---|---|---|---|
| 3,426,880 | 2/1969 | Blodgett | 197/1 R |
| 3,592,311 | 7/1971 | Chow et al. | 197/1 R |
| 3,627,096 | 12/1971 | Finnegan | 197/1 R |
| 3,759,359 | 9/1973 | Stellmach | 197/1 R |
| 3,770,095 | 11/1973 | Guerrini et al. | 197/18 |
| 3,842,955 | 10/1974 | Iwasaki | 197/1 R |

*Primary Examiner*—Ralph T. Rader

*Attorney, Agent, or Firm*—Thomas C. Siekman

[57] ABSTRACT

Apparatus for a matrix printer by which the distance between the printhead and the paper being printed upon may be adjusted. The printhead is secured to a carriage whose position may be adjusted with respect to the paper by rotating a pair of bearings that are rotatably mounted in the carriage and centrally located around a stationary shaft.

12 Claims, 9 Drawing Figures

ADJUSTABLE CARRIAGE APPARATUS

BACKGROUND OF THE INVENTION

Information generated by data processing systems if often printed in human readable form by any one of several types of highspeed printers. Often these printers are the so-called impact type where the paper being imprinted upon is forced against a platen to form the appropriate characters. Impact printers may contain a font of characters which are selectively forced against the paper to form the desired lines of characters. Another impact printer variety is the matrix printer where wires arranged in a vertical row are selectively projected out of a printhead and forced against the paper. The printhead is moved horizontally along the line being printed and across the paper to print the various characters.

With impact printers, different applications require various numbers of copies. It is common to have a number of sheets of paper interleaved with carbons, so that the appropriate number of copies may be obtained. A ribbon is placed between the printing mechanism (i.e., the printhead in matrix printers) and the first sheet of paper to imprint on the first sheet, while the carbons cause the appropriate markings to be made on the remaining interleaved sheets. In some cases, only one copy is required and, accordingly, no carbons and only one sheet of paper is used.

Since particular applications require various numbers of copies, some means must be provided for adjusting the distance between the printing mechanism and the platen in accordance with the number of sheets being imprinted. That is, if only a single sheet is to be printed, the printing mechanism must be closer to the paper and platen to operate satisfactorily. Conversely, where a larger number of copies are required, the printing mechanism must have its position moved away from the platen.

Several mechanisms have been designed to adjust the position of the printing mechanism with respect to the platen. However, all known prior adjusting mechanisms are difficult to operate and in many cases require partial disassembly of the printing mechanism. Also, the prior mechanisms have been complex, and, consequently, not easily manufacturable and assembled. The present invention overcomes these drawbacks.

SUMMARY OF THE INVENTION

According to the invention, an adjustment apparatus for supporting a printing mechanism in various positions with respect to the paper being printed upon includes a carriage for supporting the printing mechanism and a stationary shaft extending through in the carriage. Around the stationary shaft and within the carriage lies a bearing whose center line is offset with respect to the center line of the shaft. This eccentricity allows the position of the printing mechanism to be adjusted with respect to the paper by rotating the bearing.

Preferably, the carriage contains a pair of aligned bearings with enlarged ends that project from the opposing sides of the carriage. A flexible clamping member biases the enlarged ends of the bearings inwardly and is connected to the bearings so that by moving a lever integral with the clamping member, the bearings are rotated about the shaft and within the carriage. This provides a structure that is easily operated, manufactured and assembled.

DESCRIPTION OF THE PREFERRED EMBODIMENT

Figure 1:
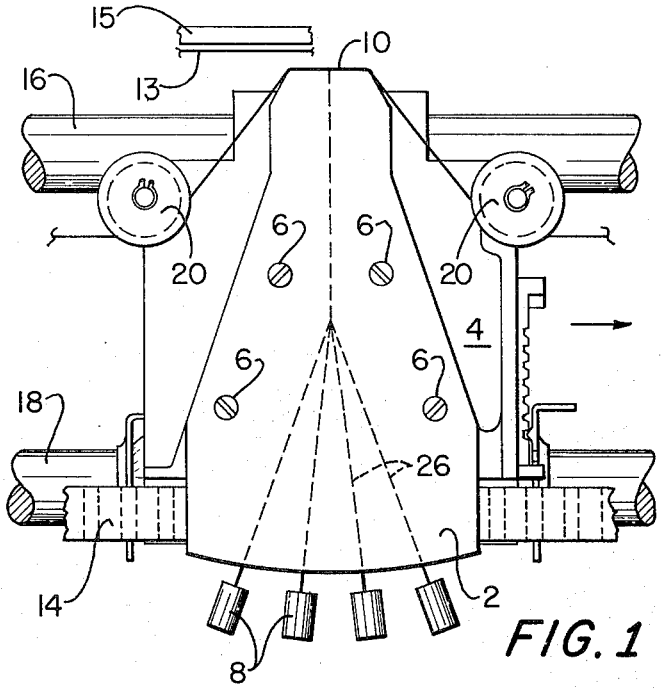
FIG. 1 is a top view of a portion of a matrix printer having an adjustable carriage apparatus in accordance with the invention.

FIG. 1 illustrates a portion of a matrix printer having a carriage for supporting the printhead and whose position may be adjusted in accordance with the invention. The printhead 2 contains a number of solenoids 8 which are selectively energized to force print-wires out of the front printing end 10 of the printhead. Only four solenoids are shown but there generally are seven with three solenoids located below the four shown. The solenoids force wires 26 through the printhead to impact a ribbon 12 against a paper 13 and a platen 15. The paper 13 may be a single sheet with the impression on it formed by the ribbon 12. Alternatively, the paper 13 may be a plurality of sheets interleaved with carbons in which case the first sheet is imprinted with the ribbon 12 and the carbons accommodate the remaining sheets. As noted above, with various numbers of copies desired, the position of the printhead 2 must be adjusted toward and away from the platen accordingly.

At the front printing end 10 of the printhead, the wires 26 are vertically arranged. When the wires are projected from the printhead, characters are formed while the printhead moves horizontally in the direction of the arrow shown along with the lines being imprinted on the paper. The printhead 2 is supported by (and secured thereto by screws 6) a carriage 4 that is slidably mounted on a pair of stationary shafts 16 and 18 extending across and substantially parallel to the paper.

As shown, the ribbon is wound around rollers 20 mounted on both sides of the printhead to be kept in position at the front of the printhead for printing. The ribbon is moved intermittently or continuously if desired to provide fresh areas of the ribbon for printing successive characters and lines. The printhead and carriage are moved by a belt 14 that extends across the paper and printer parallel to the shafts 16 and 18. The belt is driven by a motor (not shown) from left to right during each printing cycle in which one line is printed. Upon reaching the right margin, the belt is driven in the opposite direction to carry the carriage 4 and printhead 2 to the left margin of the paper to begin another line.

Figure 2:
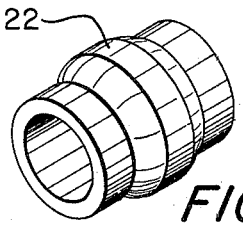
FIG. 2 is a perspective view of a front bearing used to support the carriage within the printer.
Figure 3:
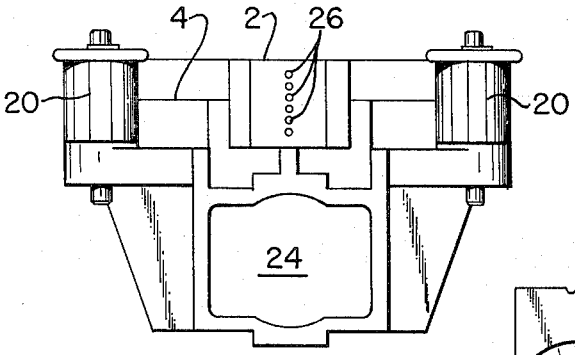
FIG. 3 is a front view of the carriage having its printhead thereon.

Referring to the front end of the carriage shown in FIG. 3 and to FIG. 1, the carriage 4 is supported within the printer at its front by the shaft 16 which projects through a bearing 22 shown in FIG. 2. The bearing 22 fits within a cavity 24 shown in FIG. 3. The cavity 24 holds the bearing with a loose fit and allows the bearing to slip within it accommodating movement of the carriage and printer toward and away from the paper and platen. This slip by bearing 22 within housing 24 also allows the carriage and printhead to move across the paper on shafts 16 and 18 even if shafts 16 and 18 are not exactly parallel since the bearing 22 may rotate within its cavity 24.

The carriage 4 and printhead 2 are adjusted toward and away from the paper by the assembly connecting the carriage 4 to the shaft 18 at the rear end of the printhead as shown in FIGS. 4 through 9.

Figure 4:
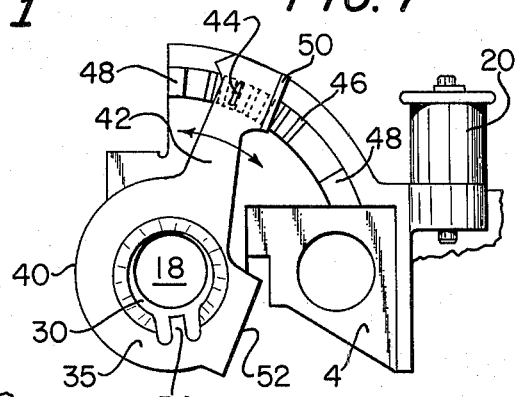
FIG. 4 is a side view of the carriage.
Figure 6:
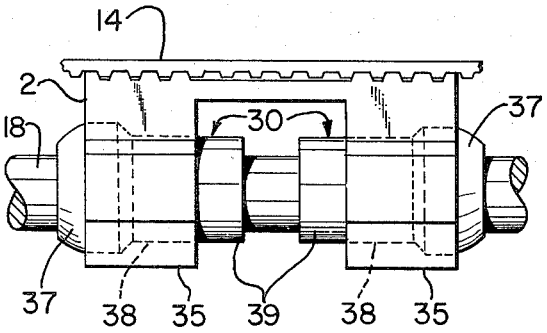

The shaft 18 is supporting the rear of the carriage projects through a pair of bearings 30 as shown in FIGS. 4 and 6. The bearings are held by a resilient retaining member 40 illustrated in FIGS. 4 and 8. FIG. 6 shows the carriage 2 and bearings 30 without the retaining number 40.

During a printing cycle within which a line is printed, the printhead is moved across and substantially parallel to the paper, riding on the shafts 16 and 18 via the front and rear bearings 22 and 30 sliding on the shafts.

Figure 7:
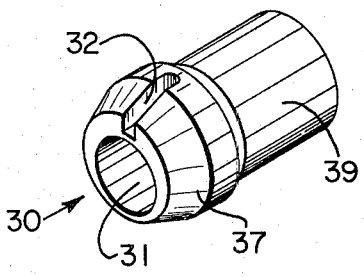
FIG. 7 is a perspective view of a rear bearing for the carriage.
Figure 5:
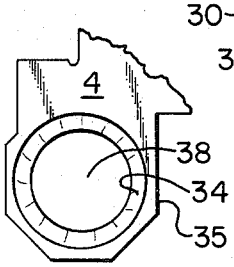
FIGS. 5 and 6 are respectively partial side and back views of the carriage.
Figure 9:
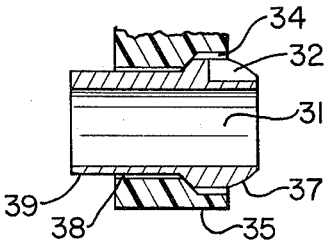
FIG. 9 is a section view showing a rear bearing positioned within the carriage.

Each bearing is shaped as shown in FIG. 7 having an enlarged end 37 and an inner cylindrical portion 39. As shown in FIGS. 6 and 9, the enlarged ends 37 of the bearings project at the outside of the carriage 4 while their cylindrical portions 39 pass through aligned bores 38 in the carriage. The surfaces of the inward sides of the enlarged ends 37 of the bearings are rounded and fit within tapered recesses 34 (FIGS. 5 and 9) at the sides of the carriage 4 that also have rounded surfaces. As shown in FIGS. 5 and 6, the bearing-receiving bores 38 of the carriage 4 are located in downwardly depending portions 35 of the carriage. FIG. 5 is a side view illustrating a portion of the carriage without the bearings 30 showing the bores 38 and recesses 34. The rounded shape of the inward sides of the enlarged ends 37 of the bearings 30 fitting within the rounded tapered recesses 34 in the carriage cause the bearings 30 to be self-aligning within the carriage; the center-lines of the two rear bearings 30 align with each other by merely being placed within the carriage's bores 38.

Within each rear bearing 30 a cylindrical bore 31 is formed that is located eccentrically with respect to the bearing's center-line and the center-line of the bore 38 in the carriage 4 receiving the bearing. The bore 31 in the two bearings 30 are aligned and closely receive the shaft 18. That is, the center-line of the bore 38 of the carriage and the center-line of the bores 31 of the bearings 30 are offset or eccentric.

The rear bearings 30 are held in place by the retaining member 40 (FIG. 8) which is of spring-like material and comprises two end portions 50 connected by a spanning member 52. Each end portion 50 is deformed at 56 outwardly to mate with the rounded shape of the outer sides of the enlarged ends 37 of the bearings 30. Each end portion also contains a substantially circular cut-out with a projection 54 inwardly depending therefrom.

As shown in FIG. 7, each rear bearing 30 has a notch 32 in its enlarged end 37 which is adapted to mate with a projection 54 in the retaining member 40. The retaining member 40 biases the flanges 37 of the bearings 30 inwardly against the carriage to hold the bearings in place. The projections 54 and notches 32 in the bearings connect the elements so that the bearings may be rotated within their respective bores 38 by rotating the retaining member 40. To facilitate this rotation, the retaining member 40 has an integral lever 42 with a projecting tab 58 that may be grasped by the printer operator.

As shown in FIG. 4, by rotating the retaining member 40 in the direction of the arrow, the rear bearings 30 are rotated within the carriage 2 due to engagement between the notches 32 in bearings and the projection 54 of the retaining member. Because of the eccentricity between the bores 31 of the bearings and the bores 38 in the carriage, the carriage will be moved to the left or right as seen in FIG. 4. As shown in FIG. 1, this operation will cause the carriage 4 and printhead 2 to be moved toward or away from the paper as desired.

To some extent, movement toward or away from the paper by the carriage in this manner is accompanied by up and down movement. However, this vertical movement is small as long as the bearings 30 are not rotated through excessively large angles.

Figure 8:
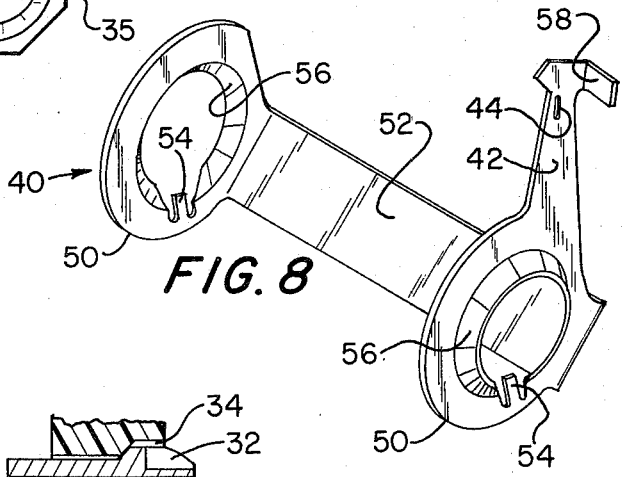
FIG. 8 is a perspective view of the rear bearing retaining member for the carriage.

As also shown in FIGS. 4 and 8, the lever 42 has a recessed portion 44 that acts as a detent with a series of grooves 46 located on the carriage to provide detented control of the position of the lever arm 42 in several discreet positions. Also, stops 48 are provided on the carriage at both ends of the series of grooves to prevent excessive movement of the lever arm.

The carriage assembly according to the invention is easily manufactured. As shown in FIG. 8, the retaining member is one piece and it, the carriage 2, the two rear bearings 30, and the front bearing 22 comprise the entire assembly except for the ribbon rollers. The retaining member 40 is resilient so that when assembling the carriage adjustment assembly the rear bearings 30 are placed in their appropriate bores in the carriage and biased inwardly by the retaining member. The front bearing 22 is merely pushed into the assembly which is then complete and ready to be slid onto the shafts 16 and 18. The two rear bearings 30 are aligned when assembled since their angular positions within the carriage are controlled by their appropriate placed notches 32 and the projections 54 of the retaining member 40.

What is claimed is:

1. Apparatus for supporting a printing mechanism adjacent to the paper being printed upon, said apparatus comprising:

A. movable carriage means supporting said printing mechanism, said carriage means having at least one first bore extending substantially parallel to said paper;

B. at least one first bearing member rotatably located in said first bore, said first bearing member containing a second bore whose center-line is substantially parallel to and offset from said first bore's center line;

C. a first shaft, fixed with respect to said paper, closely fitting within said second bore; and D. means for rotating said first bearing about said shaft, whereby said printing mechanism may be selectively positioned toward and away from said paper by rotation of said bearing.

2. Apparatus as recited in claim 1 wherein said first shaft extends across said paper and said bearing member is adapted to slide along said shaft.

3. Apparatus as recited in claim 2 and further including;

A. a second shaft fixed with respect to said paper, extending substantially parallel to said first shaft; and B. means for connecting said carriage means with said second shaft, said connecting means allowing said carriage means to move with respect to said second shaft in the direction in which said printing mechanism may be positioned.

4. Apparatus as recited in claim 3 wherein said connecting means comprises a second bearing member located on said second shaft, said carriage means containing a cavity adapted to receive said second bearing, and extending in the direction in which said printing mechanism may be positioned.

5. Apparatus as recited in claim 4 wherein said second bearing member may rotate within said cavity so that said carriage may move along said first and second shafts even if said sahfts are not exactly parallel.

6. Apparatus as recited in claim 1 wherein said carriage means contains a pair of first aligned bores, said first bearing member comprises a pair of bearings, respectively rotatably located in said first bores and containing aligned second bores, and said rotating means being adapted to rotate said pair of bearings about said first shaft.

7. Apparatus as recited in claim 6 wherein each of said pair of bearings contains an enlarged end larger than its respective bore, said bearings projecting from said first bore at opposite sides of said carriage means, said bearings being adapted to be located in said bores by insertion from said sides.

8. Apparatus as recited in claim 7 wherein the inner sides of said enlarged ends of said bearings have rounded surfaces, and each of said first bores taper and have rounded surfaces to mate with said inner sides when receiving said bearings.

9. Apparatus as recited in claim 7 wherein said means for rotating comprises means for connecting said two bearings and a lever integral with said connecting means by which said pair of bearings may be rotated.

10. Apparatus as recited in claim 9 wherein each of said pair of bearings contains a notch in its enlarged end, and said rotating means contains projections adapted to mate with said notches to rotate said pair of bearings when said lever is moved.

11. Apparatus as recited in claim 10 including a series of detent means between said lever and said carriage means for selectively positioning said lever in several discreet positions with respect to said carriage means.

12. Apparatus as recited in claim 11 wherein said rotating member is a flexible clamping means adapted to bias the enlarged ends of said pair of bearings against said carriage means to maintain said pair of bearings within said carriage means.

* * * * *